US007470359B2

(12) United States Patent
Cadours et al.

(10) Patent No.: US 7,470,359 B2
(45) Date of Patent: Dec. 30, 2008

(54) METHOD FOR EXTRACTING AN ANTIHYDRATE CONTAINED IN CONDENSED HYDROCARBONS

(75) Inventors: Renaud Cadours, Francheville (FR); Fabrice Lecomte, Paris (FR); Lionel Magna, Lyons (FR); Cécile Barrere-Tricca, Soucieu en Jarrest (FR)

(73) Assignee: Institut Francais du Petrole, Ruiel Malmaison Cedex (FR)

( * ) Notice: Subject to any disclaimer, the term of this patent is extended or adjusted under 35 U.S.C. 154(b) by 687 days.

(21) Appl. No.: 11/056,279

(22) Filed: Feb. 14, 2005

(65) Prior Publication Data

US 2005/0187421 A1 Aug. 25, 2005

(30) Foreign Application Priority Data

Feb. 13, 2004 (FR) ..... 04 01505

(51) Int. Cl.
*C10G 5/04* (2006.01)
*C10G 5/06* (2006.01)

(52) U.S. Cl. ..... 208/351; 585/802; 585/833; 62/625; 62/632

(58) Field of Classification Search ..... 203/18, 203/50, 56; 208/351; 585/800, 802, 833; 62/625, 632; 95/206, 209
See application file for complete search history.

(56) References Cited

U.S. PATENT DOCUMENTS

| | | | | |
|---|---|---|---|---|
| 6,339,182 | B1 | 1/2002 | Munson et al. | |
| 2002/0189444 | A1 * | 12/2002 | Brennecke et al. | 95/45 |
| 2004/0133058 | A1 * | 7/2004 | Arlt et al. | 585/833 |

FOREIGN PATENT DOCUMENTS

| | | | |
|---|---|---|---|
| EP | 0 362 023 | | 4/1990 |
| WO | WO 02074718 | A2 * | 9/2002 |
| WO | 2003/086605 | A2 | 10/2003 |
| WO | 2003/086605 | A3 | 10/2003 |

* cited by examiner

*Primary Examiner*—Glenn Caldarola
*Assistant Examiner*—Taiwo Oladapo
(74) *Attorney, Agent, or Firm*—Antonelli, Terry, Stout & Kraus, LLP.

(57) ABSTRACT

The method enables the antihydrate compounds contained in a condensed-hydrocarbon liquid feedstock arriving through pipe 1 to be extracted. The liquid feedstock is brought into contact, in zone ZA, with a non-aqueous ionic liquid having the general formula $Q^+ A^{31}$, where $Q^+$ designates an ammonium, phosphonium, and/or sulfonium cation, and $A^{31}$ designates an anion able to form a liquid salt. The antihydrate compounds in the liquid hydrocarbon feedstock evacuated through pipe 2 are eliminated. The ionic liquid charged with antihydrate compounds is evacuated through pipe 3, then introduced into evaporator DE to be heated in order to evaporate the antihydrate compounds. The regenerated ionic liquid is recycled through pipes 8 and 9 to zone ZA. The antihydrates are evacuated through pipe 7*a*.

14 Claims, 2 Drawing Sheets

METHOD FOR EXTRACTING AN ANTIHYDRATE CONTAINED IN CONDENSED HYDROCARBONS

The present invention relates to the extraction of antihydrate compounds contained in condensed hydrocarbons, obtained for example when processing a natural gas.

Processing a natural gas with a view to marketing involves various treatments to ensure market specifications that depend essentially on the intended application of this gas. Numerous treatments employ a compound having antihydrate properties.

For example, it is necessary to eliminate acid compounds for financial reasons, to minimize the amount of gas transported, or to comply with safety requirements in the case of sulfur-containing compounds such as hydrogen sulfide ($H_2S$), mercaptans, or carbonyl sulfide (COS). The acid compounds are generally eliminated by absorption by solvents that may contain a compound with antihydrate properties, or by adsorption on screens.

Two other commercial specifications relate to the water dewpoint of the gas and to the hydrocarbon dewpoint of the gas. In the case of cooling, the objective is to avoid condensation of some of the hydrocarbons during transportation, as well as to avoid formation of natural gas hydrates that would clog the carrying pipes. These two constraints are generally closely connected since the hydrocarbon dewpoint can be achieved by lowering the temperature in the presence of an antihydrate and dehydration can be achieved by cooling the gas and injecting a solvent with antihydrate properties.

In the case of cooling the gas and injecting a solvent with antihydrate properties such as an alcohol, for example methanol, or a glycol, for example monoethylene glycol (MEG) or diethylene glycol (DEG), the hydrocarbon dewpoint and dehydration are accomplished simultaneously. When the temperature drops, the gas gives way to a generally three-phase system: a vapor phase containing essentially methane and ethane, a liquid hydrocarbon phase containing essentially ethane, heavier hydrocarbons, and antihydrates, and an aqueous liquid phase containing most of the antihydrates and water to be eliminated.

The main drawback to the technologies using an antihydrate compound resides in the losses of antihydrate compounds in the hydrocarbon cut that is condensed during cooling. These losses can be as much as 6000 molar ppm, which is considerable in view of the flowrates generally used in natural gas processing units.

Treating the liquid hydrocarbon cut with a view to recovering this antihydrate compound has been the subject of a number of studies, but few techniques have proven to be efficient. The methods of the prior art have been incorporated into the stabilization chain of the natural gas condensates.

Because of possible formation of an azeotrope, for example of methanol and propane, it is difficult to recover antihydrates by distillation.

In the case of methanol, an original method of recovery by pasteurization was proposed and described in EP Patent 1,221,435. The objective is to extract methanol and separate C3-C4and C5+ cuts simultaneously. The limitations of this technique reside in the quantity of methanol recovered and obtaining a water-methanol liquid effluent with a low methanol concentration. The water and methanol can then be separated by distillation, but this technique generally has a high energy cost.

One alternative to distillation is to bring the feedstock gas into contact with the water-methanol liquid effluent to recover the methanol. This technique is used in the methods described in patents EP 362,023 and EP 783,031. It is efficient with two provisos: that the water-methanol liquid to be treated has a sufficiently high alcohol concentration, and that enough gas is available for the methanol to be entrained by the gas, commonly known as "stripping." This limitation directly affects the amount of water usable for washing the C3-C4 cut, and hence the amount of methanol potentially recoverable.

Another proposed recovery method is washing the methanol-rich C3-C4 cut coming from the condensate fractionation chain, with water. This washing consists of a liquid-liquid contact. This method has its limitations. If a sufficient alcohol level in the aqueous effluent obtained with a view to stripping in the crude gas is desired, methanol recovery is limited. If the goal is to recover most of the methanol, then it is necessary to perform distillation to effect the water-methanol separation. Moreover, the water-washing technique saturates the C3-C4 hydrocarbon cut with water.

The goal of the present invention is to use a non-aqueous ionic liquid for selective extraction of the antihydrate compound contained in liquid hydrocarbons.

In general, the present invention relates to a method for extracting antihydrate compounds contained in a condensed-hydrocarbon liquid feedstock, in which the following steps are carried out:

a) the feedstock is brought into contact with a non-aqueous ionic liquid so that the ionic liquid is charged with antihydrate compounds and the feedstock is impoverished of antihydrate compounds, the ionic liquid having the general formula $Q^+A^-$, where $Q^+$ designates an ammonium, phosphonium, and/or sulfonium cation, and $A^-$ designates an anion able to form a liquid salt.

b) the feedstock impoverished of antihydrate compounds and the ionic liquid charged with antihydrate compounds are separated, and c) the ionic liquid charged with antihydrate compounds is regenerated to separate the antihydrate compounds and recover an ionic liquid impoverished of antihydrate compounds.

According to the invention, in step c), the ionic liquid charged with antihydrate compounds can be heated to evaporate the antihydrate compounds and recover an ionic liquid impoverished of antihydrate compounds. The ionic liquid impoverished of antihydrate compounds in step a) can be recycled as non-aqueous ionic liquid. The ionic liquid charged with antihydrate compounds obtained in step b) can exchange heat with the ionic liquid impoverished of antihydrate compounds obtained in step c).

The present invention also relates to a method for processing a natural gas in which the following steps are carried out:

d) the natural gas is mixed with antihydrate compounds, e) the mixture is cooled so as to obtain a gas phase containing methane and ethane, a first liquid phase containing hydrocarbons and antihydrate compounds, and a second liquid phase containing water and antihydrate compounds, f) the gas phase, the first liquid phase, and the second liquid phase are separated, g) the first liquid phase is treated by the process of extracting antihydrate compounds referred to above, whereby the first liquid phase corresponds to the feedstock in step a).

The present invention also relates to a second method of treating a natural gas, in which the following steps are carried out:

h) the natural gas is mixed with antihydrate compounds, i) the mixture is cooled to obtain a gas phase containing methane and ethane, a first liquid phase containing hydrocarbons and antihydrate compounds, and a second liquid phase containing water and antihydrate compounds, j) the gas phase, the first liquid phase, and the second liquid phase are separated, k) the hydrocarbons contained in the first liquid phase are separated by distillation in order to obtain a gas fraction containing methane and ethane as well as a liquid fraction containing antihydrate compounds and hydrocarbons having at least three carbon atoms, l) the liquid fraction is treated by the process of extracting antihydrate compounds referred to above, whereby the liquid fraction corresponds to the feedstock in step a).

The present invention also relates to a third method of treating a natural gas, in which the following steps are carried out:

m) the natural gas is mixed with antihydrate compounds, n) the mixture is cooled so as to obtain a gas phase containing methane and ethane, a first liquid phase containing hydrocarbons and antihydrate compounds, and a second liquid phase containing water and antihydrate compounds, o) the gas phase, the first liquid phase, and the second liquid phase are separated, p) the hydrocarbons contained in the first liquid phase are separated by distillation in order to obtain a gas fraction containing methane and ethane as well as a liquid fraction containing antihydrate compounds and hydrocarbons having at least three carbon atoms, q) the hydrocarbons contained in the liquid fraction are separated by distillation in order to obtain a second liquid fraction containing butane, propane, and antihydrate compounds as well as a third liquid fraction containing hydrocarbons having at least five carbon atoms, r) at least one of the second and third liquid fractions is treated by the method of extracting antihydrate compounds referred to above, whereby at least one of the second and third liquid fractions corresponds to the feedstock in step a).

According to the invention, the $A^-$ anion can be chosen from groups comprising the following halide ions: nitrate, sulfate, phosphate, acetates, halogen acetate, tetrafluoroborate, tetrachloroborate , hexafluorophosphate, hexafluoroantimonate, fluorosulfonate, alkyl sulfonates, perfluoroalkyl sulfonates, bis(perfluoroalkyl sulfonyl) amides, tris-trifluoromethanesulfonyl methylide with formula $(C(CF_3SO_2)_3^-$, alkyl sulfates, arene sulfates, arene sulfonates, tetraalkyl borates, tetraphenyl borate, and tetraphenyl borates whose aromatic rings are substituted.

According to the invention, the $Q^+$ cation can have one of the following general formulas $[NR^1R^2R^3R^4]^+$, $[PR^1R^2R^3R^4]^+$, $[R^1R^2N{=}CR^3R^4]^+$, and $[R^1R^2P{=}CR^3R^4]^+$ where $R^1$, $R^2$, $R^3$, and $R^4$, which are identical or different, represent hydrogen or hydrocarbyl residues with 1 to 30 carbon atoms, except for the $NH4^+$ cation for $[NR^1R^2R^3R^4]^+$.

The $Q^+$ cation can also be derived from the nitrogen-containing and/or phosphorus-containing heterocycle having 1, 2, or 3 nitrogen and/or phosphorus atoms, the heterocycle being comprised of 4 to 10 carbon atoms.

The $Q^+$ cation can also have one of the following general formulas: $R^1R^2N^+{=}CR^3{-}R^5{-}R^3C{=}N^+R^1R^2$ and $R^1R^2P{+}{=}CR^3{-}R^5{-}R^3C{=}P{+}R^1R^2$ where $R^1$, $R^2$, and $R^3$ represent hydrogen or a hydrocarbyl residue with 1 to 30 carbon atoms and where $R^5$ represents an alkylene or phenylene residue.

The $Q^+$ cation can be chosen from the group including N-butylpyridinium, N-ethylpyridinium, pyridinium, 1-methyl-3-ethyl-imidazolium, 1-methyl-3-butyl-imidazolium, 1-methyl-3-hexyl-imidazolium, 1,2-dimethyl-3-butyl-imidazolium, diethyl-pyrazolium, N-butyl-N-methylpyrrolidinium, trimethylphenylammonium, tetrabutylphosphonium, and tributyltetradecylphosphonium.

The $Q^+$ cation can have the general formula $[SR^1R^2R^3]^+$ where $R^1$, $R^2$, and $R^3$, which are identical or different, each represent a hydrocarbyl residue with 1 to 12 carbon atoms.

According to the invention, the ionic liquid can be chosen from the group comprising N-butyl-pyridinium hexafluorophosphate, N-ethyl-pyridinium tetrafluoroborate, pyridinium fluorosulfonate, 1-methyl-3-butyl-imidazolium tetrafluoroborate, 1-methyl-3-butyl-imidazolium bis-trifluoromethanesulfonyl amide, triethylsulfonium bis-trifluoromethanesulfonyl amide, 1-methyl-3-butyl-imidazolium hexafluoroantimonate, 1-methyl-3-butyl-imidazolium hexafluorophosphate, 1-methyl-3-butyl-imidazolium trifluoroacetate, 1-methyl-3-butyl-imidazolium trifluoromethylsulfonate, 1-methyl-3-butyl-imidazolium bis(trifluoromethylsulfonyl) amide, trimethylphenylammonium hexafluorophosphate, and tetrabutylphosphonium tetrafluoroborate.

According to the invention, the antihydrate compounds can belong to one of the following groups of compounds: alcohols, glycols, and glycol ethers.

Advantageously, the method according to the invention enables antihydrates to be recovered at a high purity level, which level can be compatible with recycling back into a process.

Moreover, according to the invention, the hydrocarbon cut treated by the method according to the invention is not polluted with the ionic liquid and hence requires no additional step of treating the treated hydrocarbon cut.

In addition, the ionic liquid enables antihydrates to be recovered at any point in the stabilization chain of natural gas condensates.

The choice of technologies classically used is essentially conditional on technical limitations while, in the framework of the invention, only practical and financial considerations need be considered for choosing the position of methanol recovery in the stabilization chain.

Other features and advantages of the invention will be better understood and appear clearly when reading the description hereinbelow with reference to the drawings:

BRIEF DESCRIPTION OF THE DRAWINGS

With reference to FIG. 1, a liquid feedstock containing hydrocarbons and an antihydrate compound is introduced through pipe 1 into the contacting zone ZA. The hydrocarbons are essentially linear hydrocarbons whose chain has at least three carbon atoms. The antihydrate compound is an additive compound introduced into the hydrocarbons. The antihydrate compound prevents formation of hydrocarbon hydrates under the thermodynamic conditions of transporting and processing the feedstock. The antihydrate compound can be one or more of the compounds chosen from the following list: an alcohol such as methanol and ethanol, a glycol such as monoethylene glycol (MEG) and diethylene glycol (DEG), or a glycol ether such as tetraethylene glycol dimethyl ether and propylene glycol propyl ether. The antihydrate level can reach a concentration of 5 molar percent. The liquid feedstock can also contain light hydrocarbons such as ethane and methane, possibly acid compounds such as carbon dioxide ($CO_2$), hydrogen sulfide ($H_2S$), mercaptans, and/or carbonyl sulfide monoxide (COS), and possibly traces of water.

Figure 1:
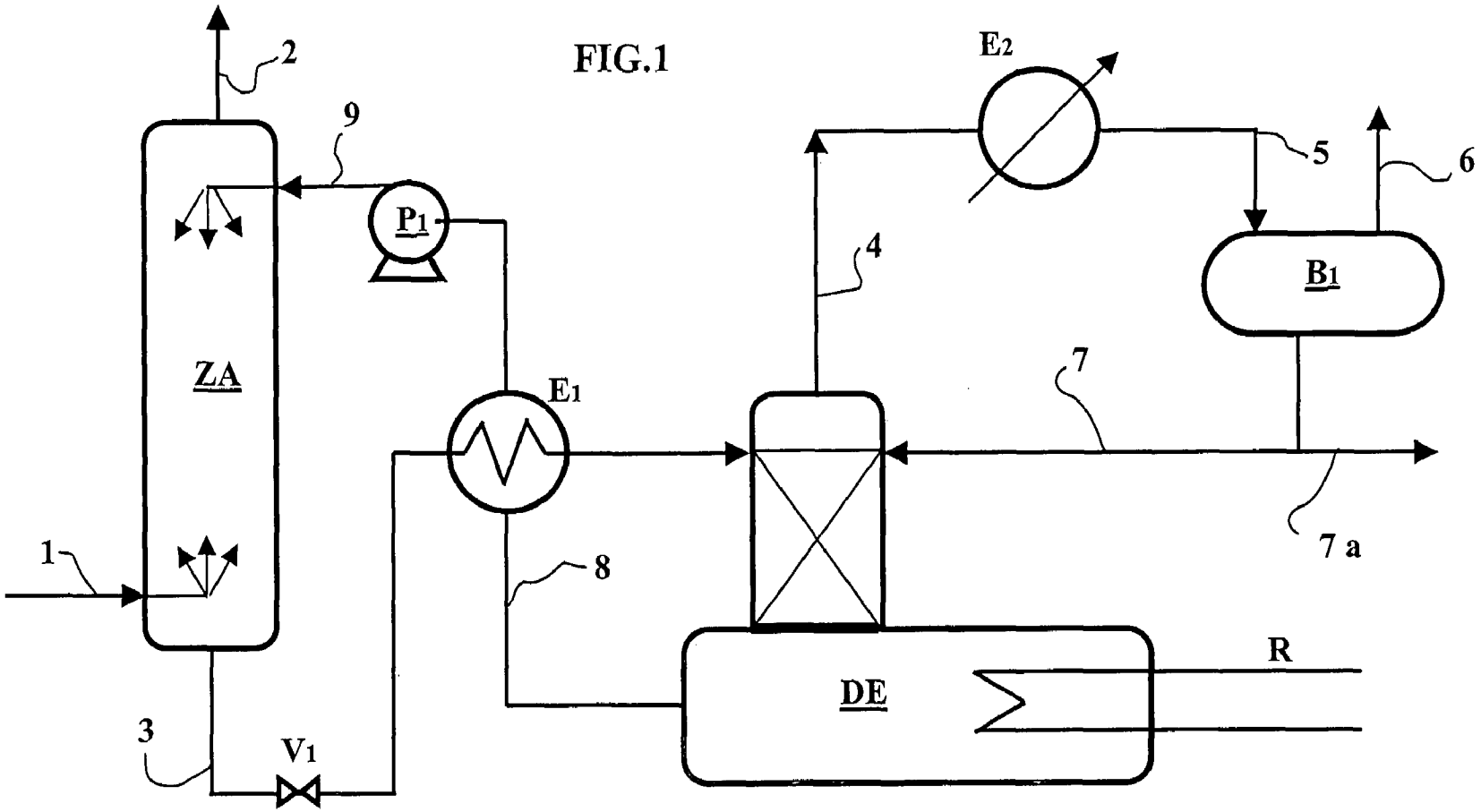
FIG. 1 shows the method of the invention schematically.

In contacting zone ZA, the liquid feedstock arriving through pipe 1 is brought into contact with a non-aqueous ionic liquid introduced through pipe 9. Before the liquid feedstock is introduced through pipe 1 into zone ZA, the pressure and/or the temperature of this liquid feedstock can be adjusted. For example the liquid feedstock circulating in pipe 1 can be heated, cooled, and/or expanded. When the liquid feedstock contacts the ionic liquid, the antihydrate compound contained in the liquid feedstock is absorbed by the ionic liquid. The hydrocarbon feedstock impoverished of antihydrates is evacuated from zone ZA through pipe 2 and the ionic liquid charged with antihydrates is evacuated from zone ZA through pipe 3.

The temperature in zone ZA can be between 20° C. and 100° C., preferably between 40° C. and 90° C. The pressure in zone ZA is chosen to be less than the vaporization pressure, i.e. below the bubble point, with the hydrocarbons of which the liquid feedstock is composed arriving through pipe 1. For example, the pressure in zone ZA can be between 1 MPa and 5 MPa.

The contacting in zone ZA can be effected by in-line mixing of the ionic liquid with the liquid feedstock, followed by separation carried out in separating drums for example. Contacting can also be done in one or more liquid washing columns, for example in columns of the perforated plate, valve, or cap types, or in packed columns with bulk or structured packing. It is also possible to use contactors to effect the contact. The contactors can be of the static or the dynamic type, followed by decanting zones. A membrane contactor can also be used, in which the liquid feedstock flows on one side of a membrane, the ionic liquid flows on the other side of the membrane, and the material exchanges take place through the membrane.

The non-aqueous ionic liquid used in the present invention is chosen from the group formed by liquid salts with the general formula $Q^+ A^-$, where $Q^+$ represents an ammonium, phosphonium, and/or sulfonium, and $A^-$ represents any organic or inorganic anion able to form a liquid salt at low temperature, namely below 100° C. and advantageously a maximum of 85° C., and preferably below 50° C.

In the non-aqueous ionic liquid with the formula $Q^+ A^-$, the $A^-$ anions are preferably chosen from the following halide anions: nitrate, sulfate, phosphate, acetate, halogen acetates, tetrafluoroborate, tetrachloroborate, hexafluorophosphate, hexafluoroantimonate, fluorosulfonate, alkyl sulfonates (for example methyl sulfonate), perfluoroalkyl sulfonates (for example trifluoromethyl sulfonate), bis(perfluoroalkyl sulfonyl) amides (for example bis-trifluoromethane sulfonyl amide with formula $N(CF_3SO_2)_2^-$), tris-trifluoromethanesulfonyl methylide with formula $(C(CF_3SO_2)_3^-$, arene sulfonates, possibly substituted by halogen or halogen alkyl groups, as well as the tetraphenylborate anion and tetraphenylborate anions whose aromatic rings are substituted.

The $Q^+$ cations are preferably chosen from the phosphonium, ammonium, and/or sulfonium group.

The ammonium and/or phosphonium $Q^+$ cations preferably have one of the general formulas $[NR^1R^2R^3R^4]^+$ and $[PR^1R^2R^3R^4]^+$, or one of the general formulas $[R^1R^2N{=}CR^3R^4]^+$, and $[R^1R^2P{=}CR^3R^4]^+$ wherein $R^1$, $R^2$, $R^3$, and $R^4$ which are identical or different, each represent hydrogen (with the exception of the $NH4^+$ cation for $[NR^1R^2R^3R^4]^+$), preferably a single substituent representing hydrogen, or hydrocarbyl residues with 1 to 30 carbon atoms, for example alkyl groups, saturated or nonsaturated, cycloalkyl, or aromatic, aryl or aralkyl, possibly substituted, with 1 to 30 carbon atoms.

The ammonium and/or phosphonium cations can also be derived from nitrogen-containing and/or phosphorus-containing heterocycles having 1, 2, or 3 nitrogen and/or phosphorus atoms, with the general formulas:

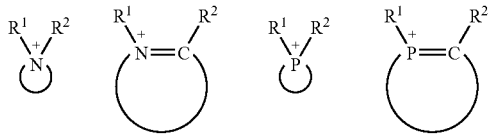

wherein the cycles are comprised of 4 to 10 atoms, preferably 5 to 6 atoms, and $R^1$ and $R^2$ are defined as above.

The ammonium or phosphonium cation can also have one of the following general formulas:

$$R^1R^2N^+{=}CR^3{-}R^5{-}R^3C{=}N^+R^1R^2 \text{ and } R^1R^2P{+}{=}CR^3R^5{-}R^3C{=}P{+}R^1R^2$$

wherein $R^1$, $R^2$, and $R^3$, which are identical or different, are defined as above and $R^5$ represents an alkylene or phenyl group. Of the $R^1$, $R^2$, $R^3$, and $R^4$ groups, the methyl, ethyl, propyl, isopropyl, secondary butyl, tertiary butyl, butyl, amyl, phenyl, or benzyl radicals may be mentioned; $R^5$ can be a methylene, ethylene, propylene, or phenylene group.

The ammonium and/or phosphonium cation $Q^+$ is preferably chosen from the group formed by N-butylpyridinium, N-ethylpyridinium, pyridinium, 1-methyl-3-ethyl-imidazolium, 1-methyl-3-butyl-imidazolium, 1-methyl-3-hexyl-imidazolium, 1,2-dimethyl-3-butyl-imidazolium, diethyl-pyrazolium, N-butyl-N-methylpyrrolidinium, trimethylphenylammonium, tetrabutylphosphonium, and tributyltetradecylphosphonium.

The sulfonium cations $Q^+$ can have the general formula $[SR^1R^2R^3]^+$, where $R^1$, $R^2$, and $R^3$, which are identical or different, each represent a hydrocarbyl residue with 1 to 12 carbon atoms, for example an alkyl group, saturated or nonsaturated, or cycloalkyl or aromatic, aryl, alkaryl, or aralkyl group having 1 to 12 carbon atoms.

The following salts usable according to the invention may be cited as examples: N-butyl-pyridinium hexafluorophosphate, N-ethyl-pyridinium tetrafluoroborate, pyridinium fluorosulfonate, 1-methyl-3-butyl-imidazolium tetrafluoroborate, 1-methyl-3-butyl-imidazolium bis-trifluoromethanesulfonyl amide, triethylsulfonium bis-trifluoromethanesulfonyl amide, 1-methyl-3-butyl-imidazolium hexafluoroantimonate, 1-methyl-3-butyl-imidazolium hexafluorophosphate, 1-methyl-3-butyl-imidazolium trifluoroacetate, 1-methyl-3-butyl-imidazolium trifluoromethylsulfonate, 1-methyl-3-butyl-imidazolium bis(trifluoromethylsulfonyl) amide, trimethylphenylammonium hexafluorophosphate, and tetrabutylphosphonium tetrafluoroborate. These salts can be used singly or mixed.

The ionic liquid circulating in pipe 3 is regenerated by separating the ionic liquid from the antihydrates. Various techniques can be used to effect this regeneration.

According to a first technique, the ionic liquid circulating in pipe 3 is regenerated by precipitating the ionic liquid by cooling and/or lowering the pressure, then separating the liquid antihydrate from the precipitated ionic liquid.

According to a second technique, the ionic liquid circulating in pipe 3 is regenerated by a technique usually known as stripping. The ionic liquid charged with antihydrate compounds is brought into contact with a fluid such that the fluid entrains the antihydrate compounds. For example, the ionic liquid charged with antihydrate compounds is brought into contact with a natural gas. Thus, the natural gas entrains the antihydrate compounds and the ionic liquid is impoverished of antihydrate compounds.

According to a third technique illustrated in FIG. 1, recovery of the antihydrates contained in the ionic liquid circulating in pipe 3 is accomplished by evaporating the antihydrates. The ionic liquid circulating in pipe 3 can be expanded by an expansion device V1, possibly introduced into a separating drum, and then heated in the heat exchanger a E1. Finally, the ionic liquid is introduced into an evaporation device DE. After expansion in V1, co-absorbed species such as hydrocarbons can be released and evacuated at the head of the separating drum. In evaporator DE, the ionic liquid is heated by reboiler R to a sufficient temperature to vaporize the antihydrates. The ionic liquid can be introduced into evaporator DE so as to be placed in contact with the vaporized antihydrates. According to one particular case, evaporation can be accomplished by distillation. The thermodynamic conditions (pressure and temperature) of evaporation are to be determined by the individual skilled in the art according to the financial considerations specific to each case. For example, evaporation can be carried out at a pressure of between 0.05 MPa and 3 MPa, and at the corresponding temperature for antihydrate evaporation. When the antihydrate is a glycol such as MEG or DEG, the temperature can be between 135° C. and 180° C. for a pressure of between 0.005 MPa and 0.1 MPa. When the antihydrate is methanol, the evaporation temperature can be between 10° C. and 140° C. for a pressure between 0.01 MPa and 1 MPa. The heat stability of the ionic liquids allows a very broad temperature range to be used.

The evaporated antihydrate, and possibly water traces, are evacuated from evaporator DE through pipe 4. The gas circulating in pipe 4 can be partially or totally condensed by cooling in the heat exchanger E2, then introduced through pipe 5 into drum B1. The portions that are not condensed are evacuated from drum B1 through pipe 6. The condensates obtained at the bottom of drum B1 constitute the antihydrate extracted from the liquid feedstock arriving through pipe 1. Some of the antihydrate extracted can be refluxed through pipe 7 into evaporator DE. Another portion of the extracted antihydrate is evacuated through pipe 7*a*.

The regenerated ionic liquid, i.e. liquid containing little or no antihydrate, is evacuated as a liquid from evaporator DE through pipe 8. The regenerated ionic liquid is cooled in heat exchanger E1, pumped by pump P1, then introduced through pipe 9 into absorption zone ZA.

The pressure and temperature conditions of evaporation in evaporator DE can be selected so as to enable any heavy hydrocarbon traces, co-absorbed by the liquid in zone ZA, to remain in the regenerated ionic liquid sent to zone ZA.

Figure 2:
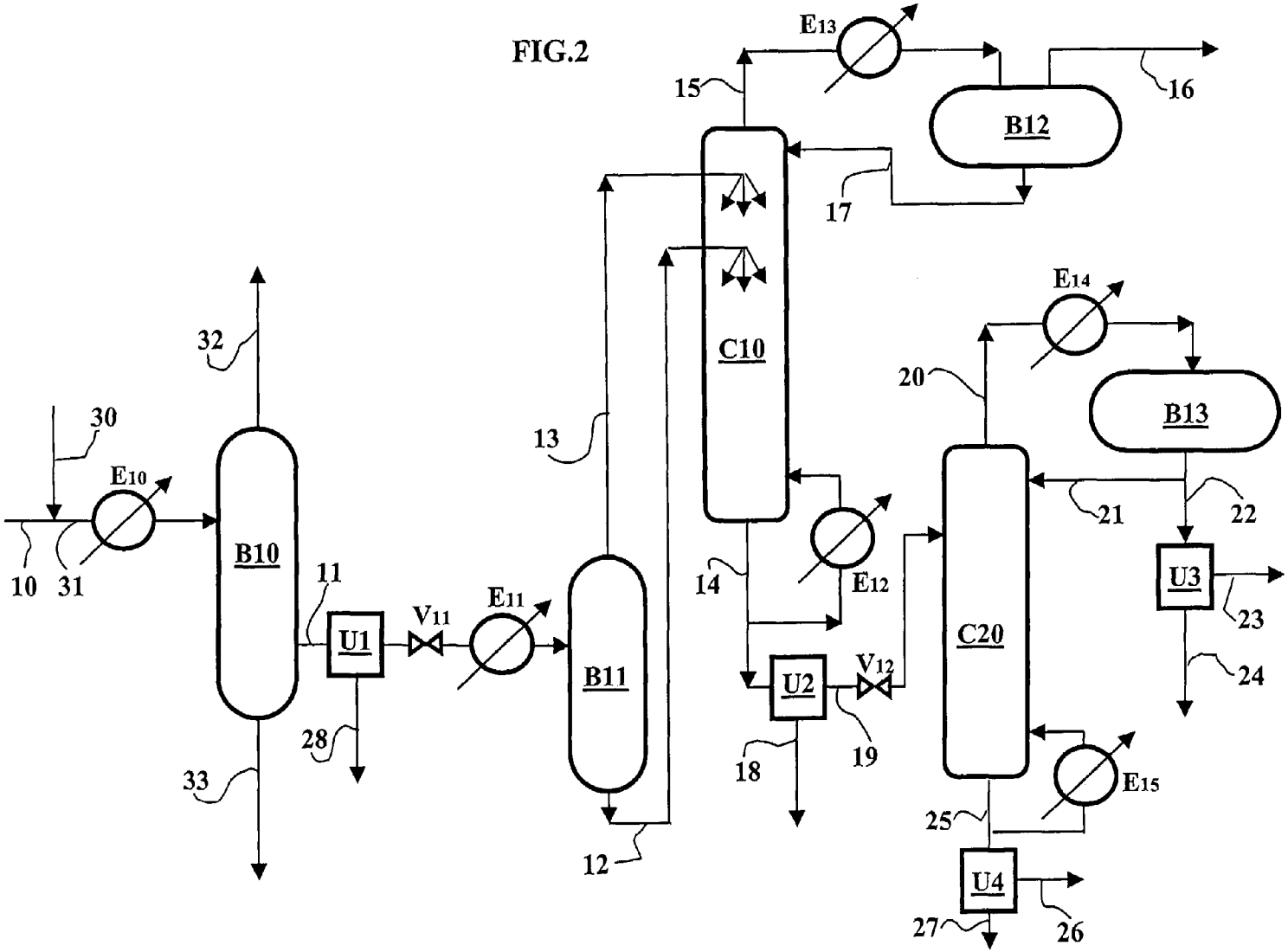
FIG. 2 shows schematically the method of the invention incorporated into a natural gas processing method.

FIG. 2 shows a method for processing natural gas into which the method described with reference to FIG. 1 is incorporated. In FIG. 2, the method according to FIG. 1 is incorporated as unit U1, or as unit U2, or as units U3 and/or U4.

In FIG. 2, the natural gas arriving through pipe 10 at a pressure between 1 MPa and 15 MPa and a temperature between 40° C. and 60° C. is saturated with water and contains hydrocarbons having one to eight carbon atoms.

The natural gas is mixed with an antihydrate injected through pipe 30. The antihydrate is a chemical compound that prevents formation of hydrocarbon hydrates, particularly methane, under the thermodynamic conditions of natural gas transportation and processing. The mixture is carried by pipe 31 to exchanger E10. Pipe 31 can be small in length, i.e. a few centimeters or meters, if the gas is processed at the production site. Pipe 31 can also be a gas pipeline for carrying gas over long distances, i.e. several kilometers, between the gas well and the gas processing facility.

The mixture of gas and antihydrates is cooled in heat exchanger E10 to a temperature between for example −30° C. and 0° C. The cooled mixture is introduced into separating device B10, for example a separating drum, in which three phases separate: a gas phase containing essentially methane, ethane, and a few traces of heavy hydrocarbons, a first liquid phase containing heavy hydrocarbons with more than three carbon atoms, antihydrates, and traces of methane, ethane, and water, and a second liquid phase composed of an aqueous antihydrate solution. The gas phase is evacuated from the head of device B10 via pipe 32 and the second liquid phase is evacuated through pipe 33. This second liquid phase can be antihydrate-concentrated, for example by distillation, then be recycled by being reinjected through pipe 30 and mixed with the gas arriving through pipe 10. The first liquid phase is evacuated through pipe 11 at a pressure of between 0.5 MPa and 12 MPa and at a temperature between 0° C. and −30° C.

The first liquid phase circulating in pipe 11 can be processed, in unit U1, by the method described with reference to FIG. 1. Unit U1 processes the feedstock arriving through pipe 11, the antihydrates being evacuated through pipe 28 and the antihydrate-impoverished effluent being evacuated through expansion device V11. Pipe 11 corresponds to pipe 1 in FIG. 1, pipe 28 corresponds to pipe 7*a* in FIG. 1, and the pipe connected to V11 corresponds to pipe 2 in FIG. 1.

However, the first liquid phase circulating in pipe 11 may not be treated in unit U1. In this case, the first liquid phase is directly transferred from drum B10 to expansion device V11 through pipe 11 to undergo various treatments designed to separate and stabilize the hydrocarbons of which this first liquid phase is composed.

The first liquid phase circulating in pipe 11 is expanded by expansion device V11, which can be a valve, a turbine, or a combination of a valve and a turbine, up to a pressure of between 0.1 MPa and 1 MPa. Next, the effluent is heated in heat exchanger E11 to a temperature of for example 20° C. to 40° C.

When it leaves exchanger E11, the effluent is introduced into the distillation column C10, commonly known as a "deethanizer." Before being introduced into column C10, the effluent can be introduced into separating device B11, for example a separating drum. The gas phase coming from the head of drum B11 is introduced into column C10 through pipe 13 and the liquid phase tapped off the bottom of device B11 is introduced through pipe 12 into column C10.

Column C10 separates the light hydrocarbons, i.e. methane and ethane, that are contained in the first liquid phase coming from drum B10, by distillation. The reboiler E12 supplies heat at the bottom of column C10. At the head of column C10, hydrocarbons in gas form are evacuated through pipe 15, cooled by heat exchanger E13 to a temperature of, for example, 40° C. to 60° C., then introduced into drum B12. The condensates recovered at the bottom of drum B12 are reinjected at the head of column C10 by pipe 17 as reflux. Light hydrocarbons such as methane and ethane are evacuated at the head of drum B12 by pipe 16. A liquid effluent containing antihydrates mixed with heavy hydrocarbons, i.e. having more than two carbon atoms, is evacuated at the bottom of column C10 through pipe 14.

The liquid effluent circulating in pipe 14 can be treated, in unit U2, by the method described with reference to FIG. 1. Unit U2 treats the feedstock arriving through pipe 14, the antihydrates being evacuated through pipe 18 and the antihydrate-impoverished effluent being evacuated through pipe 19. Pipe 14 corresponds to pipe 1 in FIG. 1, pipe 18 corresponds to pipe 7*a* in FIG. 1, and pipe 19 corresponds to pipe 2 in FIG. 1.

The liquid effluent circulating in pipe 14 can also be directly transferred to pipe 19 without undergoing treatment.

The effluent circulating in pipe 19 is expanded in expansion device V12, then introduced into the distillation column C20, commonly known as a "debutanizer." Column C20 enables separation to be effected between, on the one hand, a cut containing propane and butane and, on the other hand, a cut containing heavy hydrocarbons having at least five carbon atoms. Reboiler E15 supplies heat at the bottom of column C20. At the head of column C20, hydrocarbons and antihydrates in gas form are evacuated through pipe 20, cooled by heat exchanger E14 to a temperature of for example 40° to 60° C., then introduced into drum B13. Some of the condensates recovered at the bottom of drum B13 are reinjected at the head of column C20 through pipe 21 as reflux. A second portion of the condensates constitutes the butane/propane cut separated by column C20. This cut can contain antihydrate compounds. To recover the antihydrate compounds, the butane/propane cut can be treated, in unit U3, by the method described with reference to FIG. 1. Unit U3 processes the feedstock arriving through pipe 22, the antihydrate compounds being evacuated through pipe 23 and the antihydrate-impoverished effluent being evacuated through pipe 24. Pipe 22 corresponds to pipe 1 in FIG. 1, pipe 23 corresponds to pipe 7*a* in FIG. 1, and pipe 24 corresponds to pipe 2 in FIG. 1.

The heavy hydrocarbon cut having more than five carbon atoms is recovered at the bottom of column C20 through pipe 25. This cut can contain antihydrate compounds. To recover these antihydrate compounds, the heavy hydrocarbon cut can be treated, in unit U4, by the method described with reference to FIG. 1. Unit U4 enables the feedstock arriving through pipe 25 to be treated, the antihydrate compounds being evacuated through pipe 26, and the antihydrate-impoverished effluent being evacuated through pipe 27. Pipe 25 corresponds to pipe 1 in FIG. 1, pipe 26 corresponds to pipe 7*a* in FIG. 1, and pipe 27 corresponds to pipe 2 in FIG. 1.

According to the invention, the antihydrate compounds evacuated through pipes 28, 18, 23, and/or 26 can be recycled into the process, for example by being injected by pipe 30 to be mixed with the natural gas circulating in pipe 10.

The following numerical example illustrates the method according to the invention described with reference to FIG. 1.

The liquid effluent arrives though pipe 1 at 1.5 MPa and 55° C. and is composed of 65 molar percent propane, 31 molar percent butanes, 2 molar percent hydrocarbons with at least five carbon atoms, and 2 molar percent methanol. This effluent may come from a stabilization chain of the condensates of a natural gas, the stripping step having been conducted at a low temperature in the presence of methanol to ensure that no hydrates form.

According to the example, the ionic liquid 1-butyl-3-methylimidazolium bis(trifluoromethylsulfonyl)amide (BMIM) (TF2N) is used to recover the methanol.

In zone ZA, 8 $m^3$/h (25 kmol/h) of (BMIM) (TF2N) is introduced through pipe 9 to recover 95% of the methanol contained in the liquid effluent arriving at 1500 kmol/h through pipe 1. In this case, zone ZA can be a contactor ensuring efficiency equivalent to 4 theoretical stages.

If the ionic liquid is introduced at the rate of 20 $m^3$/h into zone ZA, zone ZA can consist of a cascade of two theoretical stages. For example, simpler technologies such as in-line mixers followed by separating drums can be used. Laboratory tests show perfect separation between the ionic liquid and the linear hydrocarbons having three to ten carbon atoms.

The methanol recovery operation is conducted in the evaporator at a pressure of 0.2 MPa to 1 MPa and a temperature of 60° C. to 150° C. in order to favor evaporation of the methanol by heating.

The invention claimed is:

1. Method for processing a natural gas in which the following steps are carried out:

a) the natural gas is mixed with antihydrate compounds, b) the mixture is cooled so as to obtain a gas phase containing methane and ethane, a first liquid phase containing hydrocarbons and antihydrate compounds, and a second liquid phase containing water and antihydrate compounds, c) the gas phase, the first liquid phase, and the second liquid phase are separated, d) at least a portion of the first liquid phase is brought into contact with a non-aqueous ionic liquid so that the ionic liquid is charged with antihydrate compounds and at least the portion of the first liquid phase is impoverished of antihydrate compounds, the ionic liquid having the general formula $Q^+ A^-$, where $Q^+$ designates an ammonium, phosphonium, and/or sulfonium cation, and $A^-$ designates an anion able to form a liquid salt, e) at least the portion of the first liquid phase impoverished of antihydrate compounds and the ionic liquid charged with antihydrate compounds are separated, and f) the ionic liquid charged with antihydrate compounds is regenerated to separate the antihydrate compounds and recover an ionic liquid impoverished of antihydrate compounds.

2. Method according to claim 1 wherein, in step f), the ionic liquid charged with antihydrate compounds is heated to evaporate the antihydrate compounds and recover an ionic liquid impoverished of antihydrate compounds.

3. Method according to claim 1, wherein the ionic liquid impoverished of antihydrate compounds in step f) is recycled as non-aqueous ionic liquid.

4. Method according to claim 1, wherein the ionic liquid charged with antihydrate compounds obtained in step e) exchanges heat with the ionic liquid impoverished of antihydrate compounds obtained in step f).

5. Method according to claim 1, wherein, before step d), the hydrocarbons contained in the first liquid phase are separated by distillation in order to obtain a gas fraction containing methane and ethane as well as a liquid fraction containing antihydrate compounds and hydrocarbons having at least three carbon atoms, and the liquid fraction is the portion of the first liquid phase treated in step d).

6. Method according to claim 4, wherein, before step d), the hydrocarbons contained in the first liquid phase are separated by distillation in order to obtain a gas fraction containing methane and ethane as well as a liquid fraction containing antihydrate compounds and hydrocarbons having at least three carbon atoms, and the hydrocarbons contained in the liquid fraction are separated by distillation in order to obtain a second liquid fraction containing butane, propane, and antihydrate compounds as well as a third liquid fraction containing hydrocarbons having at least five carbon atoms, at least one of the second and third liquid fractions is the portion of the liquid phase treated in step d.

7. Method according to claim 1, wherein the $A^-$ anion is chosen from groups comprising the following halide ions: nitrate, sulfate, phosphate, acetate, halogen acetates, tetrafluoroborate, tetrachloroborate , hexafluorophosphate, hexafluoroantimonate, fluorosulfonate, alkyl sulfonates, perfluoroalkyl sulfonates, bis(perfluoroalkyl sulfonyl) amides, tris-trifluoromethanesulfonyl methylide with formula $(C(CF_3SO_2)_3^-$, arene sulfonates, tetraphenyl borate, and tetraphenyl borates whose aromatic rings are substituted.

8. Method according to claim 1, wherein the $Q^+$ cation has one of the following general formulas $[NR^1R^2R^3R^4]^+$, $[PR^1R^2R^3R^4]^+$, $[R^1R^2N{=}CR^3R^4]^+$, and $[R^1R^2P{=}CR^3R^4]^+$ where $R^1$, $R^2$, $R^3$, and $R^4$ represent hydrogen or a hydrocarbyl with 1 to 30 carbon atoms, except for the $NH4^+$ cation for $[NR^1R^2R^3R^4]^+$.

9. Method according to claim 1, wherein the $Q^+$ cation is derived from the nitrogen-containing and/or phosphorus-containing heterocycle having 1, 2, or 3 nitrogen and/or phosphorus atoms, the heterocycle being comprised of 4 to 10 carbon atoms.

10. Method according to claim 1, wherein the $Q^+$ cation has one of the following general formulas: $R^1R^2N^+{=}CR^3{-}R^5{-}R^3C{=}N^+R^1R^2$ and $R^1R^2P{+}{=}CR^3{-}R^5{-}R^3C{=}P{+}R^1R^2$ where $R^1$, $R^2$, and $R^3$ represent hydrogen or a hydrocarbyl residue with 1 to 30 carbon atoms and where $R^5$ represents an alkylene or phenylene residue.

11. Method according to claim 1, wherein the $Q^+$ cation is chosen from the group including N-butylpyridinium, N-ethylpyridinium, pyridinium, 1-methyl-3-ethyl-imidazolium, 1-methyl-3-butyl-imidazolium, 1-methyl-3-hexyl-imidazolium, 1,2-dimethyl-3-butyl-imidazolium, diethyl-pyrazolium, N-butyl-N-methylpyrrolidinium, trimethylphenylammonium, tetrabutylphosphonium, and tributyltetradecylphosphonium.

12. Method according to claim 1, wherein the $Q^+$ cation has the general formula $[SR^1R^2R^3]^+$ where $R^1$, $R^2$, and $R^3$ each represent a hydrocarbyl residue with 1 to 12 carbon atoms.

13. Method according to claim 1, wherein the ionic liquid is chosen from the group comprising N-butyl-pyridinium hexafluorophosphate, N-ethyl-pyridinium tetrafluoroborate, pyridinium fluorosulfonate, 1-methyl-3-butyl-imidazolium tetrafluoroborate, 1-methyl-3-butyl-imidazolium bis-trifluoromethanesulfonyl amide, triethylsulfonium bis-trifluoromethanesulfonyl amide, 1-methyl-3-butyl-imidazolium hexafluoroantimonate, 1-methyl-3-butyl-imidazolium hexafluorophosphate, 1-methyl-3-butyl-imidazolium trifluoroacetate, 1-methyl-3-butyl-imidazolium trifluoromethylsulfonate, 1-methyl-3-butyl-imidazolium bis(trifluoromethylsulfonyl) amide, trimethylphenylammonium hexafluorophosphate, and tetrabutylphosphonium tetrafluoroborate.

14. Method according to claim 1, wherein the antihydrate compounds belong to one of the following groups of compounds: alcohols, glycols, and glycol ethers.

* * * * *